United States Patent [19]

Yamaguchi et al.

[11] 4,324,391

[45] Apr. 13, 1982

[54] PRE-HEATING ASSEMBLY TO BE USED FOR PRE-HEATING INGOTS

[75] Inventors: Terumoto Yamaguchi, Anjo; Masaya Ohta, Toyohashi, both of Japan

[73] Assignee: Kabushiki Kaisha Tokai Rika Denki Seisakusho, Aichi, Japan

[21] Appl. No.: 156,873

[22] Filed: Jun. 5, 1980

[30] Foreign Application Priority Data

Jun. 15, 1979 [JP] Japan ..... 54-82710

[51] Int. Cl.[3] ..... F27B 1/20; F27B 14/00

[52] U.S. Cl. ..... 266/200; 266/100; 266/901; 432/13; 432/14

[58] Field of Search ..... 266/901, 900.1, 200; 75/43, 44 R, 65; 432/13, 14, 130, 164

[56] References Cited

U.S. PATENT DOCUMENTS

| | | | |
|---|---|---|---|
| 524,551 | 8/1894 | Hughes | 75/44 R |
| 1,871,863 | 8/1932 | Stansfeld | 432/150 X |
| 2,446,637 | 8/1948 | Crampton et al. | 75/65 R |
| 3,658,307 | 4/1972 | Richardson et al. | 432/13 |
| 3,864,122 | 2/1975 | Seelig | 75/3 |

*Primary Examiner*—G. O. Peters

*Attorney, Agent, or Firm*—Wenderoth, Lind & Ponack

[57] ABSTRACT

A pre-heating assembly to be used for pre-heating ingots being transported to a melting furnace, which includes an inner cylinder constituting a main passage for exhaust gas discharged from a flue of the melting furnace, an outer cylinder which is positioned around the inner cylinder to leave a subsidiary passage for the exhaust gas between the two cylinders, an ingot supplying passage spirally provided along the outermost circumference of the inner cylinder, in which the ingots, each having a spherical configuration like a ball, roll down the passage in succession so that each ingot is preheated prior to its introduction into the melting furnace, and a connector support member, on which both cylinders are mounted and the bottom portion of the connector support member is coupled to the outlet of the flue.

8 Claims, 2 Drawing Figures

PRE-HEATING ASSEMBLY TO BE USED FOR PRE-HEATING INGOTS

BACKGROUND OF THE INVENTION

This invention relates to improvements in a pre-heating assembly to be used for pre-heating ingots each being transported to a melting furnace such as a pot of a casting apparatus for a die-casting operation, and more particularly, to a pre-heating apparatus having a special advantage for pre-heating a type of ingot having a spherical configuration like a ball.

Normally, the temperature inside a melting furnace such as a casting pot for use in a die-casting operation is maintained at an extremely high temperature. Such being the case, with respect to supply of ingots to such a high temperature condition, whenever the ingot is supplied to the pot without any pre-heating treatment thereof, the temperature of the molten metal contained in the pot is caused to be drastically decreased. In a continuous die-casting process, the variation of the temperature of the molten metal should be avoided. Thus, so long as such an operational defect as described above is not overcome, mass production of cast objects each having a constant high quality can hardly be achieved. Therefore, in order to prevent the occurrence of such an undesirable operational condition, the ingots are preferably pre-heated prior to their being supplied to the melting furnace. However, up to the present, such a pre-heating of the ingots has not been specifically taken into consideration in this field.

Simply, in order to accomplish such pre-heating of the ingots, the conventional die-casting process can be modified to include a separate pre-heating step by means of an independent pre-heating means. However, such an arrangement gives rise to another undesirable problem, i.e., an additional apparatus cost and more particularly, an additional manufacturing cost.

The inventors of the present invention have already purposed special ingots having a spherical configuration like a ball so that the ingot can be easily treated or handled at any station in the casting process, the details of which have been disclosed in Japanese Utility Model Application dated Dec. 29, 1976, or Japanese Laid Open Patent Application (Tokkaisho) 54-43835. The pre-heating asembly of the present invention is based upon the specific characteristics of the ingots described above as will be described hereinafter.

SUMMARY OF THE INVENTION

Accordingly, an essential object of the present invention is to provide a pre-heating assembly to be used for pre-heating ingots each being transported to a melting furnace such as a pot of a casting apparatus or the like.

Another important object of the present invention is to provide a pre-heating assembly of the above-described type, which takes advantage of the heat of burning gas discharged from a melting furnace.

A further object of the present invention is to provide a pre-heating assembly of the above-described type, which takes advantage of the capability of the ingots each having a spherical configuration to roll.

A still further object of the present invention is to provide a pre-heating assembly of the above-described type, which has a simple construction and is highly efficient in use.

A further object of the present invention is to provide a pre-heating assembly of the above-described type, which can be manufactured at low cost.

In accomplishing these and other objects according to one preferred embodiment of the present invention, there is provided a pre-heating assembly to be used for pre-heating ingots each being transported to a melting furnace such as a pot of a casting apparatus or the like. The pre-heating assembly comprises an inner cylindrical member constituting a main passage for exhaust gas discharged from the melting furnace; an outer cylindrical member, which is assembled in a manner such that the inner cylindrical member is surrounded by the outer cylindrical member, thereby to define a subsidiary passage for the exhaust gas between the inner cylindrical member and the outer cylindrical member; an ingot supplying passage means in one of said passages, the ingots, each having a spherical configuration, rolling down the ingot supplying passage in succession, so that each of the ingots is pre-heated prior to its introduction into the melting furnace; and a coupling support member, on which the inner cylindrical member and the outer cylindrical member are mounted, the bottom end portion of the coupling support member being coupled to the outlet of a flue of the melting furnace. Both the inner cylindrical member and the outer cylindrical member are respectively provided with a lid at the bottom portion thereof, so that either the main passage or the subsidiary passage can be selectively shut off from the exhaust gas.

More specifically, the ingot supplying passage is spirally provided along the outermost circumferential surface of the inner cylindrical member. The ingot supporting passage comprises at least two strip members each concentrically spaced with respect to the longitudinal axis of the inner cylinder, each of the strip members extending spirally around the outermost circumferential surface of the inner cylindrical member. The upper strip member of the two strip members is concentrically spaced with respect to the outermost circumferential surface described above at a distance substantially corresponding to the diameter of the ingot. Accordingly, the ingot rolls down the passage, so that two radially opposite, spherical surface portions of the ingot are slidably in contact with the upper strip member and the outermost circumferential surface described above, with the bottom of the ingot being supported by the other strip member.

Furthermore, the pre-heating assembly further includes a transporting pipe having one end connected to the lower end of the ingot supplying. The transporting pipe member includes an operational rod with a loading portion extending in a radial direction into the inside of the transporting pipe, a stop, the leading portion of which also extends in a radial direction into the inside of the transporting pipe and a link arm connecting the respective operational rod and stop at respective ends thereof in a manner such that the leading portions can be alternately extended into the inside of the transporting pipe. Both leading portions are spaced from each other by a distance which substantially corresponds to the diameter of the ingot. Accordingly, if the operation of the operational rod is appropriately controlled, the supply rate of the ingots can be well controlled.

As is clear from the description of the present invention, the pre-heating assembly takes advantage of the heat of the exhausted gas discharged from the flue in the most effective way. Furthermore, the pre-heating assembly per se has a simple construction and thus can be manufactured at low cost.

BRIEF DESCRIPTION OF THE DRAWINGS

These and other objects and features of the present invention will become apparent from the following description of a preferred embodiment thereof taken together with the accompanying drawings in which.

Before the description of the present invention proceeds, it is to be here noted that like parts are designated by like reference numerals throughout the several views of the accompanying drawings.

DETAILED DESCRIPTION OF THE INVENTION

Figure 1:
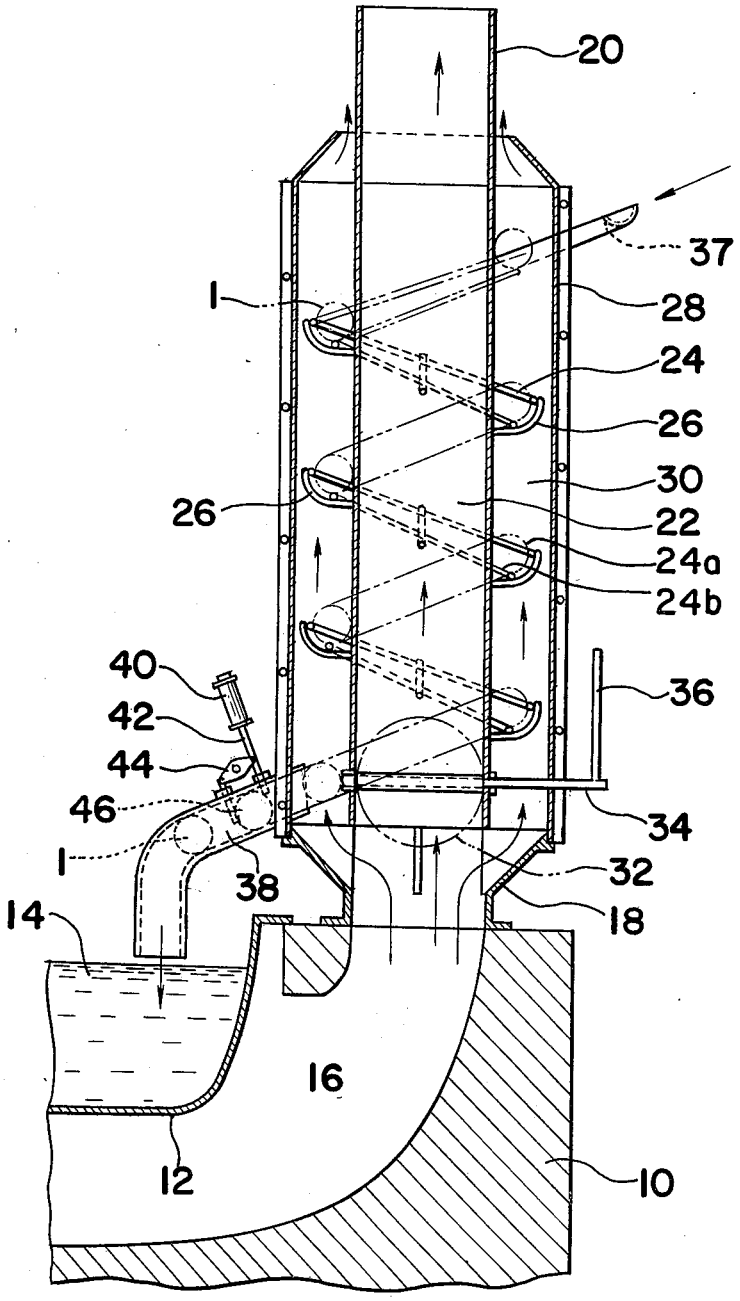
FIG. 1 is a schematic side sectional view of a pre-heating assembly for pre-heating ingots according to the present invention, the assembly being shown as being mounted on a melting furnace.

Referring now to FIG. 1, there is shown a pre-heating assembly to be used for pre-heating ingots 1. The pre-heating assembly comprises an inner cylinder member 20 constituting a main exhaust passage 22 for exhaust gas discharged from a melting furnace; an outer cylindrical member 28, which is concentrically positioned around the inner cylindrical member 20, thereby to provide a subsidiary exhaust passage 30 between them; and an ingot feeding or supplying passage 24 spirally mounted along the outermost circumferential surface of the inner cylindrical member 20.

The pre-heating member is mounted on a body portion 10 of a melting furnace such as a pot of a casting apparatus for use in a die-casting operation as shown in FIG. 1. The melting furnace is provided with a motlen metal basin 12, in which liquid or molten metal 14 which has been thermally melted and having a high temperature, for example, more than 420° C., is contained. The molten metal 14 is used for a casting operation such as a die-casting operation. Inside the body portion 10, there is provided a flue 16. The flue 16 exhausts a burning gas, which has already been used for thermally melting the metal 14 contained in the melting metal basin 12, to the outside of the furnace.

Figure 2:
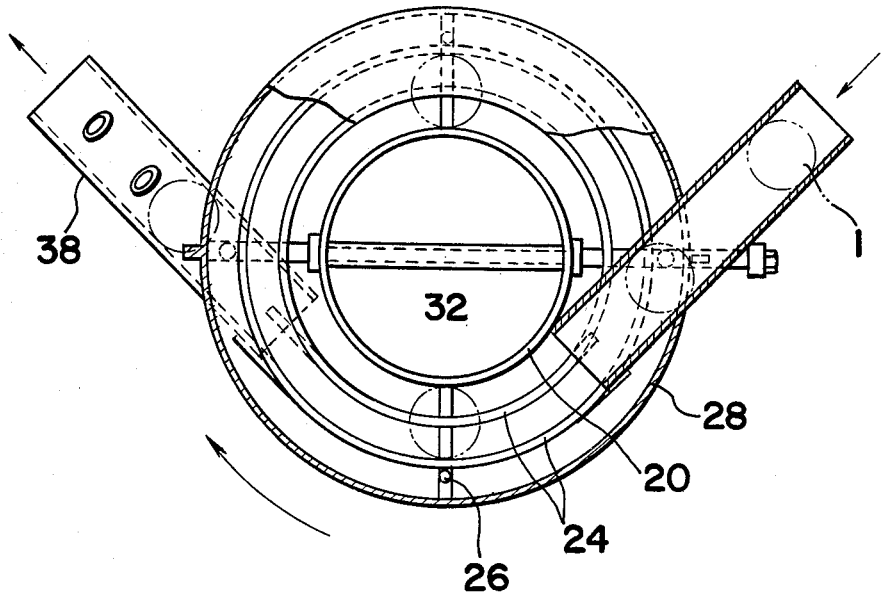
FIG. 2 is a schematic, partial, top plan view of the pre-heating assembly as shown in FIG. 1.

There is provided a coupling support 18 for coupling the outlet of the flue 16 of the body portion 10 to the bottom of the cylindrical members 20 and 28. In the central portion of the coupling support member 18, the inner cylindrical member 20 is held vertically, so that there is provided the main exhaust passage 22 for the exhausted burning gas discharged from the outlet of the flue 16. The outermost circumferential surface of the inner cylindrical member 22 is surrounded by the ingot supplying passage means 24, which comprises at least two strip members **24*a* and 24*b* each concentrically spaced with respect to the longitudinal center axis of the inner cylindrical member 20, and each of the strip members extending spirally around the outermost circumferential surface of the inner cylindrical member 22. The upper strip member 24*a* of two strip members is concentrically spaced from the outermost circumferential surface by a distance substantially corresponding to the diameter of an ingot 1. Accordingly, as will be described hereinafter, the ingot 1 rolls down the passage means 24, and the two radially opposite, spherical surface portions of the ingot 1 are in sliding contact with the upper strip member 24*a* and the outermost circumferential surface, and the bottom of the ingot 1 is supported by the other strip member 24*b*. The strip members are supported by supporting members 26 mounted at intervals on the outermost circumferential surface of the inner cylindrical member 22. According to the present embodiment shown in FIG. 2, there are four vertical rows of the supporting members 26, two rows being disposed radially oppositely with respect to each other. The respective supporting members 26 in the vertical rows are spaced apart relative to each other at a predetermined vertical distance. Thus, with this arrangement of the spiral feeding passage means 24, the spherical ingots 1 will roll down along the outermost circumferential surface of the inner cylindrical member 20 from an ingot feeding position, which is designated by an arrow in an upper right portion of FIG. 1, since the spherical ingots have a good rolling capability. More specifically, according to this embodiment, the specific combination of the arrangement of the spirally shaped feeding passage means 24 and the best rolling capability of the spherical ingots cause the ingots 1 to roll smoothly down the passage means. During the course of the rolling, each ingot 1 is pre-heated by the heat from the exhausted burning gas discharged from the flue 16**.

The inner circumferential surface of the outer cylindrical member 28 is spaced from the outermost surface of the inner cylindrical member 20 by an appropriate distance, which is large enough to permit the spiral feeding passage means 24 to be provided therein. The outer cylindrical member 28 is supported on the coupling support member 18 at the bottom portion thereof and has an inlet to the subsidiary exhaust passage 30. The upper cylindrical portion; of the outer cylindrical member 28 has a reduced diameter toward the top portion thereof. Thus, the auxiliary or subsidiary exhaust passage 30 is provided between the outer cylindrical member 28 and the inner cylindrical member 20, through which the exhausted burning gas discharged from the flue 16 can be by-passed. The exhausted burning gas by-passed to the auxiliary exhaust passage also serves to directly pre-heat the ingots rolling down the spiral feeding passage means 24, accordingly. To the top end portion of the spiral feeding passage means 24 is connected a transporting pipe 37 of an ingot feeding apparatus including an article elevating device (not shown). On the other hand, a transporting pipe 38 is coupled to an outlet at the bottom portion of the spiral feeding passage means 24, so that the ingots rolling down the spiral feeding passage 24 can be introduced into the molten metal 14 contained in the molten metal basin 12. As can be seen in FIG. 1, a hydraulic piston cylinder device 40 is mounted on the transporting pipe 38 in a manner such that a leading portion of a rod 42 thereof can extend into the inside of the transporting pipe 38 radially. Furthermore, a leading portion of a stop 46 also extends into the inside of the transporting pipe 38 radially, and the other end is connected to the rod 42 through a pivoted link arm 44. The leading portion of the stop 46 is spaced from the leading portion of the rod 42 by a distance, which almost corresponds to the diameter of an ingot 1. By the arrangement as described above, the supply of the ingots can be controlled with respect to the rate and the number of the ingots.

More specifically, in the embodiment as described above, either of the leading portion of the rod 42 on the leading portion of the stop 46 is alternately projected into the inside of the transporting pipe 38. Thus, when the rod 42 is projected radially into the inside of the transporting pipe 38, the ingot 1 which has rolled down toward the passage means 24 is prevented from rolling further by the leading portion of the rod 42. Thereafter, the ingot 1 thus blocked by the leading portion of the rod 42 will begin to roll down the pipe 38 when the leading portion of the rod 42 is withdrawn. However, because of the connection between the rod 42 and the stop 46, the leading portion of the stop 46 is at the same time projected radially into the inside of the transporting pipe 38 by the movement of the link arm 44, and thus, the ingot 1 is again blocked from further rolling by the leading portion of the stop 46, after rolling a distance approximately corresponding to the diameter of the ingot 1. Next, when the rod 42 is again projected into the inside of the transporting pipe 38, the leading portion of the stop 46 is retracted, accordingly, and thus the ingot 1 held thereby is released and falls into the metal basin 12 after rolling down the rest of the transporting pipe 38. As is clear from the foregoing description, if the operation of the cylinder 40 is appropriately controlled, the supply rate of the ingots can be controlled, whereby the amount of the molten metal 14 contained in the basin 12 can be maintained in a constant state.

In order to carry out an exact control of the supply of the ingots 1 with the cylinder 40, the cylinder 40 may be connected to a timer circuit, so that the operational speed etc. of the cylinder 40 can be controlled in a predetermined manner.

In the following, the operational characteristics of the pre-heating apparatus of the present invention are described.

The ingots 1, which have been transported to the inlet portion of the spiral feeding passage means 24 via the transporting pipe 37 of an ingot feeding apparatus including an article elevating device (not shown here), roll down the spiral feeding passage means 24. More specifically, the ingots 1 come down the passage means 24, which is spirally provided in the space 30 enclosed by the inner cylindrical member 20 and the outer cylindrical member 28, and constituting the subsidiary exhaust passage. Normally, since a circularly shaped damper or lid 34 provided for closing the bottom end of the inner cylindrical member 20 is turned up as specifically shown by dotted lines in FIG. 1, the exhausted burning gas discharged through the flue 16 is discharged upwardly through both the main exhaust passage 22 in the inner cylindrical member 20 and the subsidiary exhaust passage 30. Accordingly, the ingots 1 introduced into the pre-heating apparatus are not only pre-heated directly by the heat from the exhausted burning gas flowing upwardly inside the subsidiary exhaust passage 30, but also pre-heated indirectly by the heat caused by the exhausted burning gas flowing upwardly inside the main exhaust passage 22. Thus, the pre-heating of the ingots according to the present invention can be accomplished in quite an effective manner. Due to such an effective pre-heating operation as described above, the ingots are pre-heated up to a predetermined temperature prior to their introductions into the transporting pipe 38. The ingots 1 each having a predetermined temperature are successively discharged into the molten metal 14 in the basin 12 through the transporting pipe 38, while the supply rate or the number of the ingots 1 are well controlled.

In a case where a rapid pre-heating operation must be carried out, the lid 34 is pivotally moved by 90 degrees so as to completely close the bottom end of the inner cylindrical member 20, i.e., the main exhaust passage 20. Thereby, all the exhausted burning gas discharged from the flue 16 flows upwardly through the subsidiary exhaust passage 30 having an annular cross section. Accordingly, the ingots 1, which roll down through the subsidiary exhaust passage 30, are directly pre-heated by the heat from the exhausted burning gas, whereby rapid and effective pre-heating of the ingots 1 can be accomplished.

On the other hand, when it is necessary to prevent the ingots 1 from being excessively pre-heated, the lid 32 may be turned up again as described hereinabove. Alternatively, the subsidiary exhaust passage 30 may be provided with a damper or lid, and the lid 32 can be omitted, or both the lid 32 and a lid for the passage 30 can be provided. Furthermore, it is possible to modify the present invention by providing the spiral feeding passage means 24 in the inner cylindrical member 20.

According to the embodiment described above, to turn the lid 32 up 90 degrees from its substantially horizontal state, a lever 36 is manipulated. However, the lever 36 can be automatically operated by a piston cylinder means etc. in response to a temperature detecting means such as a bimetal thermal switch. In such a case, the temperature detecting means is disposed at an appropriate position in the path of the exhausted burning gas, so that the position of the lid 32 together with the pre-heating temperature of the ingots are automatically controlled in response to any change of the temperature. Accordingly, the control of the pre-heating temperature is performed in quite a precise and prompt manner.

Furthermore, although the pre-heating apparatus having the inner cylindrical member 20 circular in cross section and the outer cylindrical member 28 circular in cross section is described in the foregoing description, these members 20 and 28 do not necessarily have to have a circular cross section, but alternatively can have a square cross section or a rectangular cross section if necessary. However, as can be seen from the foregoing description, it is most convenient to employ cylindrical members for these inner and outer members, when the ease of making the spiral feeding passage means between these two members is taken into consideration.

As is described in the foregoing, in the pre-heating apparatus of the present invention, the ingots are pre-heated by taking advantage of the heat of the exhausted burning gas discharged from the melting furnace, whereby the exhausted burning gas is used for pre-heating the ingots in the most profitable way. As a result, the pre-heating operation of the ingots can be performed at low cost. In addition, since the pre-heating of the ingots is performed in the most effective way by the heat-exchange between the ingots and the exhausted burning gas, the occurrence of the drastic temperature changes of the molten metal contained in the melting furnace is definitely avoided. Particularly, since the exhaust path of the burning gas is through the inner passage and the outer surrounding passage and it is further possible to cause the path of the exhausted burning gas to be changed as described above, whereby the control of the pre-heating temperature of the ingots can be performed in the most effective way.

Although the present invention has been fully described by way of example with reference to the accompanying drawings, it is to be noted here that various changes and modifications will be apparent to those skilled in the art. Therefore, unless otherwise such changes and modification depart from the scope of the present invention, they should be construed as being included therein.

What is claimed is:

1. A pre-heater for pre-heating ingots being supplied to a melting furnace such as a pot of a casting apparatus, comprising:

a first elongated hollow member constituting a first passage for exhaust gas discharged from the melting furnace;

a second elongated hollow member concentric with said first hollow member and defining a second passage for exhaust gas between said first hollow member and said second hollow member;

a damper in the lower end of at least one of said passages for substantially closing off the passage to the flow of exhaust gas; and an ingot supplying passage means sloping downwardly through said one passage for guiding movement of successive ingots down along said ingot supplying passage means for pre-heating each of said ingots prior to its introduction into the melting furnace.

2. A pre-heater as claimed in claim 1, wherein there is a damper in the lower end of said first and said second hollow passages, whereby said first passage and said second passage can be selectively closed.

3. A pre-heater as claimed in claim 1, wherein both said first hollow member and said second hollow member are cylindrical members.

4. A pre-heater for pre-heating ingots being supplied to a melting furnace such as a pot of a casting apparatus, comprising:

a first elongated hollow member constituting a first passage for exhaust gas discharged from the melting furnace;

a second elongated member concentric with said first hollow member and defining a second passage for exhaust gas between said first hollow member and said second hollow member;

an ingot supplying passage means sloping downwardly through one of said passages for guiding movement of successive ingots down along said ingot supplying passage means for pre-heating each of said ingots prior to its introduction into the melting furnace;

a transporting pipe member connected to the lower end of said ingot supplying passage means;

a blocking rod means having a lead portion movable in a radial direction into the inside of said transporting pipe member;

a stop having a leading portion also movable in a radial direction into the inside of said transporting pipe member, said leading portion of said stop being spaced from said leading portion of said blocking rod means a distance which substantially corresponds to the largest dimension of the ingot; and a link arm connecting said blocking rod means and said stop for moving said stop in response to movement of said blocking rod means for moving said leading portion of said blocking rod means and said leading portion of said stop alternately into the inside of said transporting pipe member.

5. A pre-heater as claimed in claim 4, wherein both said first hollow member and said second hollow member are cylindrical members.

6. A pre-heater as claimed in claim 4, further comprising a damper in the lower end of said one of said passages for substantially closing off the passage of the flow of exhaust gas.

7. A pre-heater as claimed in claim 6, wherein both said first hollow member and said second hollow member are cylindrical members.

8. A pre-heater as claimed in claim 7, in which said downwardly sloping ingot supplying passage means is spirally downwardly sloping.

* * * * *